US007223972B2

(12) United States Patent
Vassiliou et al.

(10) Patent No.: US 7,223,972 B2
(45) Date of Patent: May 29, 2007

(54) STABILIZATION OF A MAGNETIC SECTION OF A MASS SPECTROMETER

(75) Inventors: Eustathios Vassiliou, Newark, DE (US); Gottfried P. Kibelka, Seattle, WA (US)

(73) Assignee: OI Corporation, College Station, TX (US)

( * ) Notice: Subject to any disclaimer, the term of this patent is extended or adjusted under 35 U.S.C. 154(b) by 127 days.

(21) Appl. No.: 11/097,465

(22) Filed: Mar. 31, 2005

(65) Prior Publication Data

US 2005/0263714 A1 Dec. 1, 2005

Related U.S. Application Data

(60) Provisional application No. 60/557,968, filed on Mar. 31, 2004.

(51) Int. Cl.
*H01J 49/30* (2006.01)

(52) U.S. Cl. ..... 250/298; 250/282

(58) Field of Classification Search ..... None
See application file for complete search history.

(56) References Cited

U.S. PATENT DOCUMENTS 2,964,627 A * 12/1960 Wild ..... 250/299
4,409,482 A 10/1983 Scheid et al.
6,403,956 B1 * 6/2002 Sinha ..... 250/298
6,635,883 B2 * 10/2003 Torti et al. ..... 250/298

FOREIGN PATENT DOCUMENTS

GB 674729 A 7/1952
GB 1396937 A 6/1975

OTHER PUBLICATIONS

Van Der Walt, N. T., "The Control and Stabilization of the Magnetic Field for a Mass Spectrometer," The Review of Scientific Instruments, 24(6): 413-416, Jun. 1953.
Hadfield, D., et al., "Permanent Magnets for Spectrographs and Nuclear Physical Research," British Journal of Applied Physics, 3(6): 199-202, Jun. 1952.
Dodson, M. H., "Stabilization of Magnetic Field Using a Flux-Integrating Circuit," Journal of Physics E. Scientific Instruments, 3(9): 708-710, Sep. 1, 1970.

* cited by examiner

*Primary Examiner*—Jack I. Berman
(74) *Attorney, Agent, or Firm*—Seed IP Law Group PLLC

(57) ABSTRACT

An analytical instrument, such as a mass spectrometer, the instrument having a magnetic section with a controllable electromagnetic field. Controlling the electromagnetic field is accomplished by controlling a temperature of a base plate within the magnetic section, by controlling a current passing through an electromagnetic coil disposed within the magnetic, by disposing a magnetic shunt across a portion of a yoke of the magnet, or by any of the above either independently or in combination. The magnetic shunt is configured to have a temperature coefficient of remnant flux density that is opposite the temperature coefficient of remnant flux density of a first pair of permanent magnets located within the magnetic section.

16 Claims, 7 Drawing Sheets

STABILIZATION OF A MAGNETIC SECTION OF A MASS SPECTROMETER

CROSS-REFERENCES TO RELATED APPLICATION

This application claims the benefit of U.S. Provisional Patent Application No. 60/557,968 filed on Mar. 31, 2004 where this provisional application is incorporated herein by reference in its entirety.

BACKGROUND OF THE INVENTION

1. Field of the Invention

This disclosure pertains to a magnetic section of a mass spectrometer, in particular, devices and methods for controlling a magnetic flux within the magnetic section.

2. Description of the Related Art

Mass spectrometry is widely used in many applications ranging from process monitoring to life sciences. Over the course of the last 60 years, a wide variety of instruments have been developed. The focus of new developments has been two fold: (1) a mass spectrometer (MS) having a high mass range and a high mass resolution, and (2) a small, desktop MS instrument.

MSs are often coupled with gas chromatographs (GC) into a gas chromatograph/mass spectrometer instrument (GC/MS) for analysis of complex mixtures, for example volatile compounds (VOCS) and semi-volatile compounds (semi-VOCs). A GC/MS instrument typically includes a gas inlet system, an electron impact based ionizer (EI) with ion extractor, optic elements to focus an ion beam, ion separation, and ion detection. Ionization can also be carried out via chemical ionization.

Ion separation can be performed in the time or spatial domain. An example of ion separation in the time domain is a time of flight mass spectrometer. Time domain ion separation is the method of ion separation commonly used in quadrupole MSs. One common type of a quadrupole mass filter allows only one mass/charge ratio to be transmitted from the ionizer to the detector. A full mass spectrum is recorded by scanning the mass range through a mass filter. Another time domain ion separation method is based on a magnetic fields where either the ion energy or the magnetic field strength is varied. Again, the mass filter allows only one mass/charge ratio to be transmitted.

Ion separation in the spatial domain is accomplished by spatially separating the ions in a magnetic field and detecting a position of the ions when they impact a position sensitive detector.

One type of MS is a double focusing MS introduced by Mattauch and Herzog (MH) in 1940 (Mattauch J., Herzog R., Über einen neuen Massenspektographen. Z. Physik, 89: (1934) 786–795. This type of MS is commonly referred to as a Mattauch-Herzog MS.

Double focusing refers to the MS's ability to refocus both an energy spread and a spatial beam spread. Modern developments in magnet and micro machining technologies allow dramatic reductions in the size of the MSs. Thus, the length of a focal plane in a modern-developed MS is reduced to a few centimeters.

The typical specifications of a small confocal plane layout Mattauch-Herzog instrument are summarized below:

Electron impact ionization, Rhenium filament
DC-voltages and permanent magnet
Ionization Energy: 0.5–2.5 kV DC
Mass Range: 2–200 D Faraday cup detector array or strip charge detector
Duty Cycle: >99%
Read-Out time: 0.001 sec to 10 sec The ion optic elements can be mounted in the vacuum chamber floor on a vacuum chamber wall. In small instruments, the ion optic elements can be located on a base plate, which acts as an "optical bench" and holds all of the ion optic elements. The base plate is mounted against a vacuum flange to provide the vacuum seal needed to operate the MS under vacuum. The base plate can also be the vacuum flange itself.

The ion detector in a Mattauch-Herzog MS is a position sensitive detector. Recent developments focus on solid state based direct ion detection as an alternative to previously used electro-optical ion detectors (EOIDs).

The EOID converts the ions in a multi-channel-plate into electrons, amplifies the electrons, and illuminates a phosphorus film with the electrons. The image formed on the phosphorus film is recorded with a photo diode array via a fiber optic coupler as described in U.S. Pat. No. 5,801,380. The EOID can perform a simultaneous measurement of ions spatially separated along the focal plane of the MS. In addition, the electrons may be further converted to photons that form images of the ion-induced signals.

The ions generate electrons by impinging on a microchannel electron multiplier array. The electrons are accelerated to a phosphor-coated fiber-optic plate that generates photon images using a photodetector array. Some drawbacks of the EOID is that it requires multiple conversions. In addition, the use of phosphors may limit the dynamic range of the EOID. The microchannel device may require a high-voltage, for example 1 KV, which could require that the microchannel device be placed in the vacuum chamber under a pressure of about 106 Torr. Under such pressure, the microchannel device may experience ion feedback, electric discharge, and fringe magnetic fields may affect the electron trajectory. Further, a resolution of the EOID may be adversely affected by isotropic phosphorescence emission, which may also affect the resolution of the mass analyzer.

Another type of detector is a micro-machined Faraday cup detector, which comprises an array of individually addressable Faraday cups for monitoring the ion beam. One type of Faraday cup detector is described in detail in "A. A. Scheidemann, R. B. Darling, F. J. Schumacher, and A. Isakarov, Tech. Digest of the 14th Int. Forum on Process Analytical Chem. (IFPAC-2000), Lake Las Vegas, Nev., Jan. 23–26, 2000, abstract 1–067"; "R. B. Darling, A. A. Scheidemann, K. N. Bhat, and T. C. Chen, Proc. of the 14th IEEE Int. Conf. on Micro Electro Mechanical Systems (MEMS 2001), Interlaken, Switzerland, Jan. 21–25, 2001, pp. 90–93"; and U.S. patent application Ser. No. 09/744,360.

Other references of interest are "Nier, D. J. Schlutter Rev. Sci. Instrum. 56(2), page 214–219, 1985"; and "T. W. Burgoyne et. al. J. Am. Soc. Mass Spectrum 8, pages 307–318, 1997."

Another type of detector that can be used for low energy ions is a flat metallic strip, called a strip charge detector (SCD).

Yet another type of detector is a shift register based direct ion detector, which is described in U.S. Pat. No. 6,576,899.

The shift register based direction detector may be used in a GC/MS instrument. The shift register based direct ion detector allows direct measurement of ions in a MS without conversion to electrons and photons (e.g., EOID) prior to measurement. The shift register based direct ion detector may incorporate charge coupled device (CCD) technology, which includes the use of metal oxide semiconductors.

Detected charged particles form a signal charge that directly accumulates in a shift register associated with a part of the CCD. The signal charge can be clocked through the CCD to a single output amplifier. Since the CCD uses only one charge-to-voltage conversion amplifier, signal gains and offset variations of individual elements in the detector array can be minimized.

In the Mattauch-Herzog MS, the detector, which can be a Faraday cup detector, a strip charge detector, or one of the aforementioned detectors, is placed at an exit of a magnet section called a focal plane.

In a Mattauch-Herzog MS, the ion optic elements are placed on the vacuum chamber wall and the ion detector is mounted on an exit flange of the ion flight path. This arrangement is required as a result of having the magnet section outside of the vacuum chamber. A multiplexer and an amplifier are also positioned outside of the vacuum chamber in the Mattauch-Herzog MS.

FIG. 1 shows a Mattauch-Herzog double focusing MS 10 assembled with a GC 12, the MS 10 includes an ionizer 14, a shunt and aperture 16, an electro static energy analyzer 18, a magnetic section 20, and a focal plane section 22.

In the operation of the MS 10, a gaseous material or a vapor is introduced into the ionizer 14, either directly or through the GC 12 (for complex mixtures or compounds). The material is bombarded by electrons to produce ions. The ions are focused in the shunt and aperture section 16 to form an ion beam 24. The ions are separated according to their charge/mass ratio as they move through the electro static energy analyzer 18 and the magnetic section 20. The ions are then detected in the focal plane section 22, as described in U.S. Pat. No. 5,801,380. The ion separation process takes place under a vacuum pressure on the order of about $10^{-5}$ Torr, which can be achieved with a vacuum pump (not shown).

The GC 12 includes a sample injector valve V, which has an entry port S for introduction of the sample, an exit port W for the waste after the sample has been vaporized and/or decomposed, typically by heat. The sample injector valve V may be a liquid injector. The part to be analyzed, referred to as analyte is carried by a carrier gas, such as dry air, hydrogen, or helium, for example, to a capillary microbore column M (wall coated open tubular, or porous layer open tubular, or packed, etc.), where its constituents are separated by different absorption rates on the wall of the microbore column M. The microbore column M has a rather small inside diameter, of the order of about 50–500 μm in the illustrated embodiment. The carrier gas flow rate is about 0.2 to 5 atm. $cm^3$/sec, although higher flow rates, for example 20 atm. $cm^3$/sec, are possible.

A larger microbore column M bore requires a larger vacuum pump, whereas a smaller bore produces narrower peaks of the effluent, which may result in a loss of signal. In general, the gas flow rate is a function of the inner diameter, the length of the column M, the pressure of the carrier gas, and the temperature of the carrier gas. The width of the peak again is a function of the injection time, the stationary phase of the column (e.g., polarity, film thickness, distribution in the column), the width and length of the column, the temperature and the gas velocity. One method of determining a size of the microbore column M bore is addressed in U.S. Pat. No. 6,046,451.

Temperature variations, especially in the magnetic section of the MS, induce the need for frequent calibrations of the MS. The temperature variations can be caused by environmental factors and/or from internal components, such as the ionizer, which utilizes a hot electrode (e.g., a glowing rhenium filament). Frequent calibrations are time consuming and operators tend to avoid them, which eventually leads to inaccuracy in the measurements.

Permanent magnets located in the magnetic section may be especially susceptible to the temperature variations. It is understood that the volume and the mass of a permanent magnet is typically inversely proportional to an energy product value of the magnet. One type of magnetic material is AlNiCo V, which has an energy product of about 5–6 MGOe. Other magnet materials include, but are not limited to steel, Sm—Co alloys and Nd—B—Fe alloys. These materials are sensitive to temperature variations. Methods for temperature compensation to avoid frequent instrument calibrations and/or other issues are described in U.S. Pat. No. 6,403,956 and in U.S. Provisional Patent Application No. 60/557,920.

Other patents of interest are U.S. Pat. No. 5,317,151; U.S. Pat. No. 6,182,831; and U.S. Pat. No. 6,191,419.

BRIEF SUMMARY OF THE INVENTION

In one aspect, a magnetic section of an analytical instrument includes a yoke having a main body, a first yoke end, and a second yoke end; a first permanent magnet coupled to the yoke proximate to the first yoke end; a second permanent magnet coupled to the second yoke end, wherein the second permanent magnet is spaced apart from the first permanent magnet to form a magnetic gap therebetween; a coil formed around at least a portion of the yoke, the coil configured to carry a current, wherein a magnetic flux is produced when the current passes through the coil; a magnetic sensor disposed in the vicinity of the magnetic gap to produce signals indicative of a measurement of the magnetic flux; and a controller in communication with the magnetic sensor and the coil, the controller configured to receive the signals indicative of the measurement of the magnetic flux from the magnetic sensor and to regulate the current passing through the coil to controllably maintain the magnetic flux within a desired range.

In another aspect, a mass spectrometer includes a base plate; a vacuum housing comprising at least one wall and a vacuum flange configured to form a vacuum chamber, the vacuum flange sealingly coupled to the base; a magnetic section supported on the base plate, the magnetic section includes a yoke having a main body, a first yoke end, and a second yoke end; a first permanent magnet coupled to the yoke proximate to the first yoke end; a second permanent magnet coupled to the second yoke end, wherein the second permanent magnet is spaced apart from the first permanent magnet to form a magnetic gap therebetween; a coil formed around at least a portion of the yoke, the coil configured to carry a current, wherein a magnetic flux is produced when the current passes through the coil; a magnetic sensor disposed in the vicinity of the magnetic gap to produce signals indicative of a measurement of the magnetic flux; and a controller in communication with the magnetic sensor and the coil, the controller configured to receive the signals indicative of the measurement of the magnetic flux from the magnetic sensor and to regulate the current passing through the coil to controllably maintain the magnetic flux within a desired range.

In yet another aspect, a mass spectrometer includes a base plate; a vacuum housing comprising at least one wall and a vacuum flange configured to form a vacuum chamber, the vacuum flange sealingly coupled to the base; a magnetic section configured to generate a magnetic flux and supported on the base plate; a first heating element located within a first portion of the base plate; a first temperature sensor located within a second portion of the base plate; and a temperature controller in electrical communication with the first heating element and the first temperature sensor, wherein the temperature controller is configured to regulate the first heating element to control a temperature of the base plate and to controllably maintain the magnetic flux within a desired range.

In yet another aspect, a method of controlling a level of magnetic flux in a magnetic section of an analytical instrument includes measuring the magnetic flux present within a region of the magnetic section; and controlling an amount of current passing through a coil within the magnetic section based on the measured magnetic flux, wherein the current is controlled to maintain the magnetic flux within a desired range.

In still yet another aspect, a method of controlling a temperature within a region of a magnetic section of a mass spectrometer includes measuring a base plate temperature with a temperature sensor disposed within a first region of the base plate; determining an amount of temperature adjustment for a heating element disposed within the first region of the base plate in response to the measured base plate temperature; and controllably adjusting a temperature of the heating element to controllably maintain an amount of relative separation between a first pair of permanent magnets located within the magnetic section and to controllably maintain a magnetic flux present between the first pair of permanent magnets within a desired range.

In yet another aspect, a spectroscopic segment includes a magnetic section comprising a yoke having a main body and yoke-ends, a permanent magnet attached to each one of the yoke-ends, in a manner to form a magnetic gap having a magnetic field, a magnetic sensor disposed in the vicinity of the magnetic gap, an electric coil at least partially around the yoke; and an electromagnet controller connected to the magnetic sensor and to the coil.

The controller receives magnetic flux information from the magnetic sensor and regulates a current passing through the coil, so that the magnetic flux detected by the magnetic sensor is maintained at a desired level.

The magnetic section may further include a magnetic shunt disposed within the yoke and having an opposite temperature coefficient of remnant flux density compared to the permanent magnets attached to the ends of the yoke.

The inclusion of the magnetic shunt may reduce deviations in the magnetic flux within the magnetic gap while minimizing the current required to maintain the magnetic flux in a desired range. Temperature changes in the magnetic section may cause the deviations in the magnetic flux.

In yet another aspect, a spectroscopic segment includes a base plate having a front end and a back end; an ionizer disposed in the vicinity of the front end of the base plate, and the magnetic section disposed in the vicinity of the back end of the base plate; a first heating element disposed in a position selected from within the base plate, on the base plate, and in the vicinity of the base plate; and a first temperature sensor disposed in a position selected from within the base plate, on the base plate, and in the vicinity of the base plate.

Additionally or alternatively, the first heating element and the first temperature sensor can be disposed within the base plate. In addition, the first temperature sensor can be disposed in a vicinity of the first heating element. Both the first temperature sensor and the first heating element can be disposed in a back end of the base plate in one alternate embodiment.

A second temperature sensor may be selectively positioned within the magnetic section, on the magnetic section, or in the vicinity of the magnetic section.

Controlling the temperature of the base plate is one method of controlling the magnetic flux in the magnetic gap. While the temperature of the base plate is changing, deviations in the magnetic flux can be controlled by an electromagnet controller, which includes a magnetic sensor for measuring the magnetic flux. Based on the measured magnetic flux, the electromagnet controller adjusts current to the coil by an appropriate amount and direction so that the magnetic flux remains within the desired range.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with mass spectrometer instruments have not been shown or described in detail to avoid unnecessarily obscuring descriptions of the embodiments.

Unless the context requires otherwise, throughout the specification and claims which follow, the word "comprise"

and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the embodiments.

The disclosure herein generally relates to a magnetic section of a mass spectrometer (MS) where an electromagnetic field within the magnetic section is controllably adjustable. It is understood and appreciated that the MS disclosed herein may be configured with other MSs, gas chromatographs (GC), or other instruments.

Figure 1:
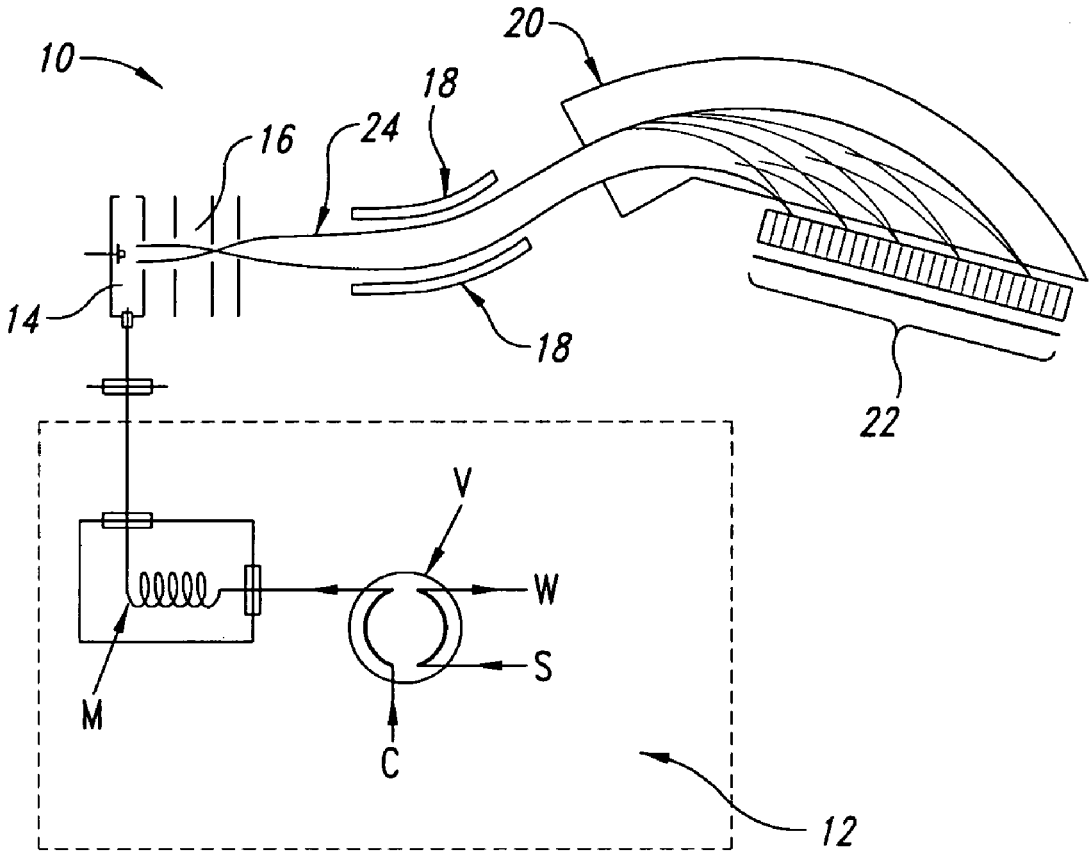
FIG. 1 (Prior Art)
FIG. 1 is a schematic view of a prior art Mattauch-Herzog mass spectrometer connected to a gas chromatograph.
Figure 2:
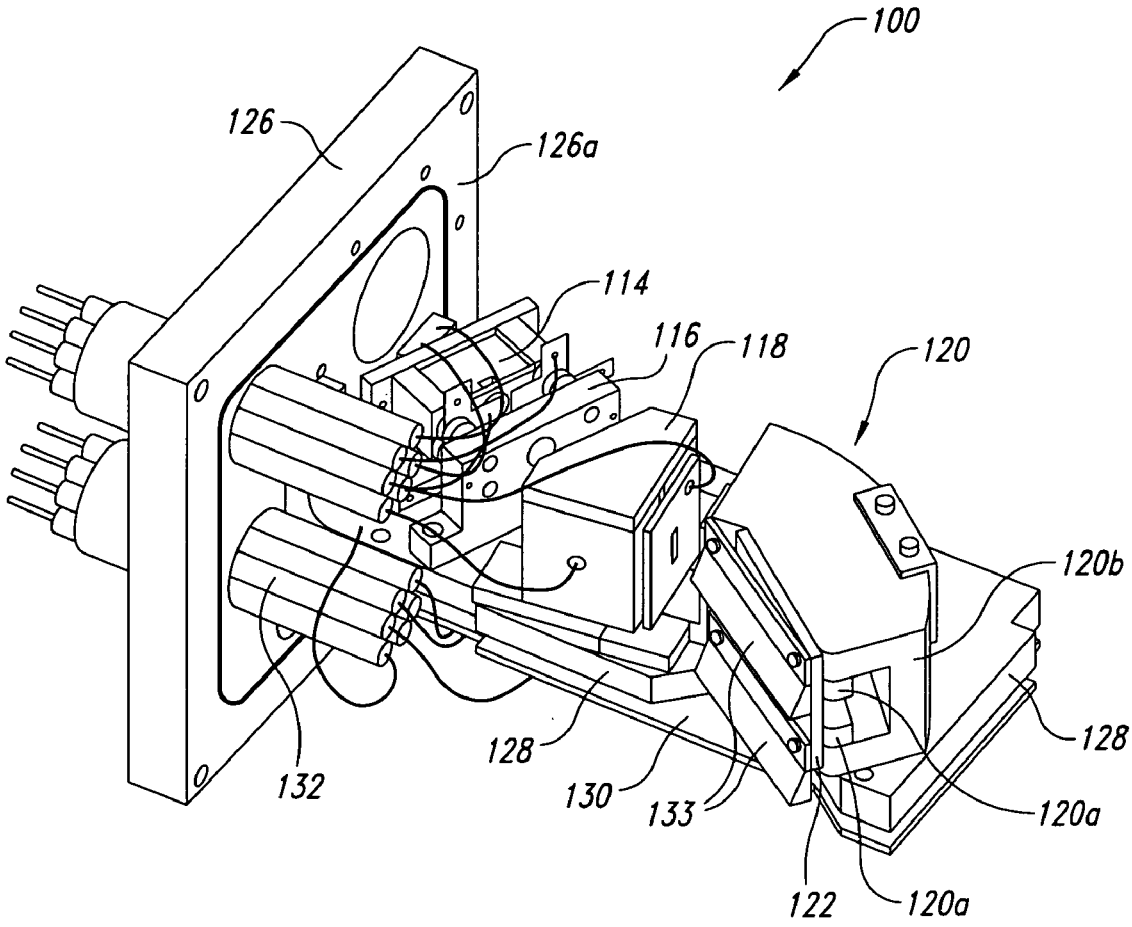
FIG. 2 is a top, front, right isometric view of a Mattauch-Herzog mass spectrometer having a vacuum flange, base plate, an ionizer, an electro static energy analyzer, a magnetic section, and a focal plane section according to one illustrated embodiment.

FIG. 2 shows a mass spectrometer 100 having an ionizer 114, a shunt and aperture 116, an electro static energy analyzer 118, a magnetic section 120, and a focal plane 122. The magnetic section 120 includes a yoke 120*b* and magnets 120*a* coupled to the yoke 120*b*. The information received at the focal plane 122 can be transferred to a multiplexer/amplifier 130, which may be located under a base plate 128 and connected to the focal plane 122 with flexible connectors 133.

The base plate 128 is supported on a vacuum flange 126, which includes a front face 126*a*. A vacuum housing (not shown) is secured to the front face 126*a* of the flange 126 to form a vacuum chamber. The base plate 128 has a front-end 128*a* and a back end 128*b*, as better illustrated in FIGS. 7 and 8.

In one embodiment, the ionizer 114, the shunt and aperture 116, the energy analyzer 118, the magnetic section 120, and the focal plate 122 are supported on the base plate 128. This configuration is advantageous over mounting the aforementioned components on a wall of the vacuum housing because the wall of the vacuum housing moves due to differential pressure when the vacuum chamber is pressurized. Slight, relative movement of these components may alter their delicate alignment. In the illustrated embodiment, the base plate 128 is subjected to approximately equal pressure on all sides because the base plate 128 is located completely within the vacuum housing. Thus, the alignment of the components is less likely to be altered when the vacuum chamber formed by the vacuum housing is pressurized.

A number of vacuum-sealed input/output leads 132 are disposed on the vacuum flange 126 for communication purposes between various components within the vacuum housing. The leads 132 may also communicate with other components located outside of the vacuum housing.

In one embodiment, the magnets 120*a* of the yoke 120*b* has a saturation value of at least 15,000 G. In another embodiment, the magnets 120*a* of the yoke 120*b* has a saturation value of more than 20,000 G. The magnets 120*a* of the yoke 120*b* are made from hyperco-51A VNiFe alloy according to one embodiment.

Figure 4:
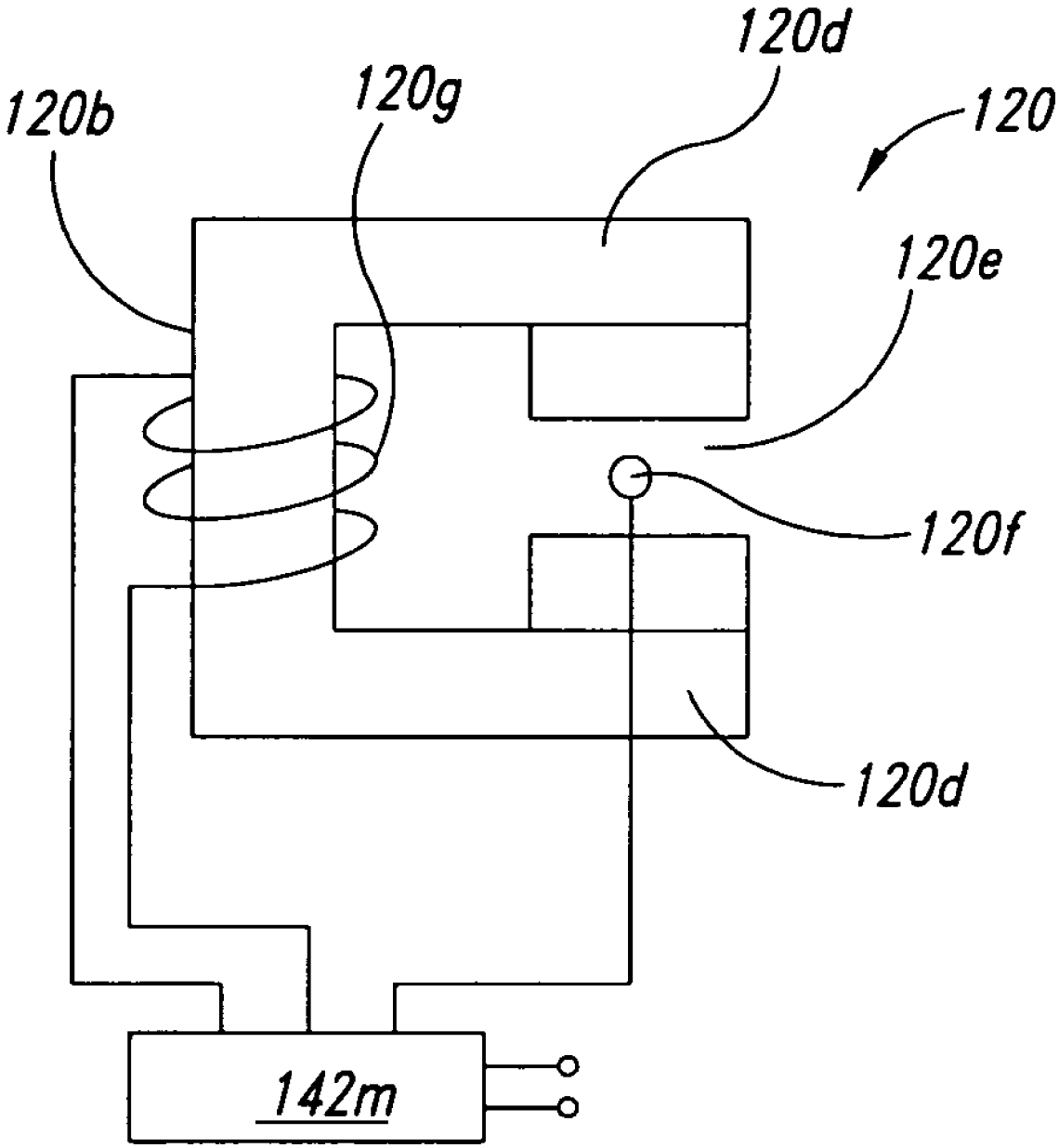
FIG. 4 is a schematic view of a magnetic section of a mass spectrometer according to one illustrated embodiment.

FIG. 4 shows a magnetic section 120 having a yoke 120*b* with a main body 120*c* and yoke-ends 120*d* according to one illustrated embodiment. Permanent magnets 120*a* are attached to each one of the respective yoke-ends 120*d*, in a manner to form a magnetic gap 120*e*. During operation, a magnetic field is generated within the magnetic gap 120*e*. A magnetic sensor 120*f* is disposed in the vicinity of the magnetic gap 120*e*, while an electric coil 120*g* is disposed at least partially around the yoke 120*b*.

An electromagnet controller 142*m* (FIG. 4) is in communication with the magnetic sensor 120*f*, and to the electric coil 120*g*.

The electromagnet controller 142*m* receives magnetic flux information from the magnetic sensor 120*f* and regulates a current passing through the coil 120*g*. The magnetic flux detected by the magnetic sensor 120*f* can be controlled and maintained within a desired range.

Figure 5:
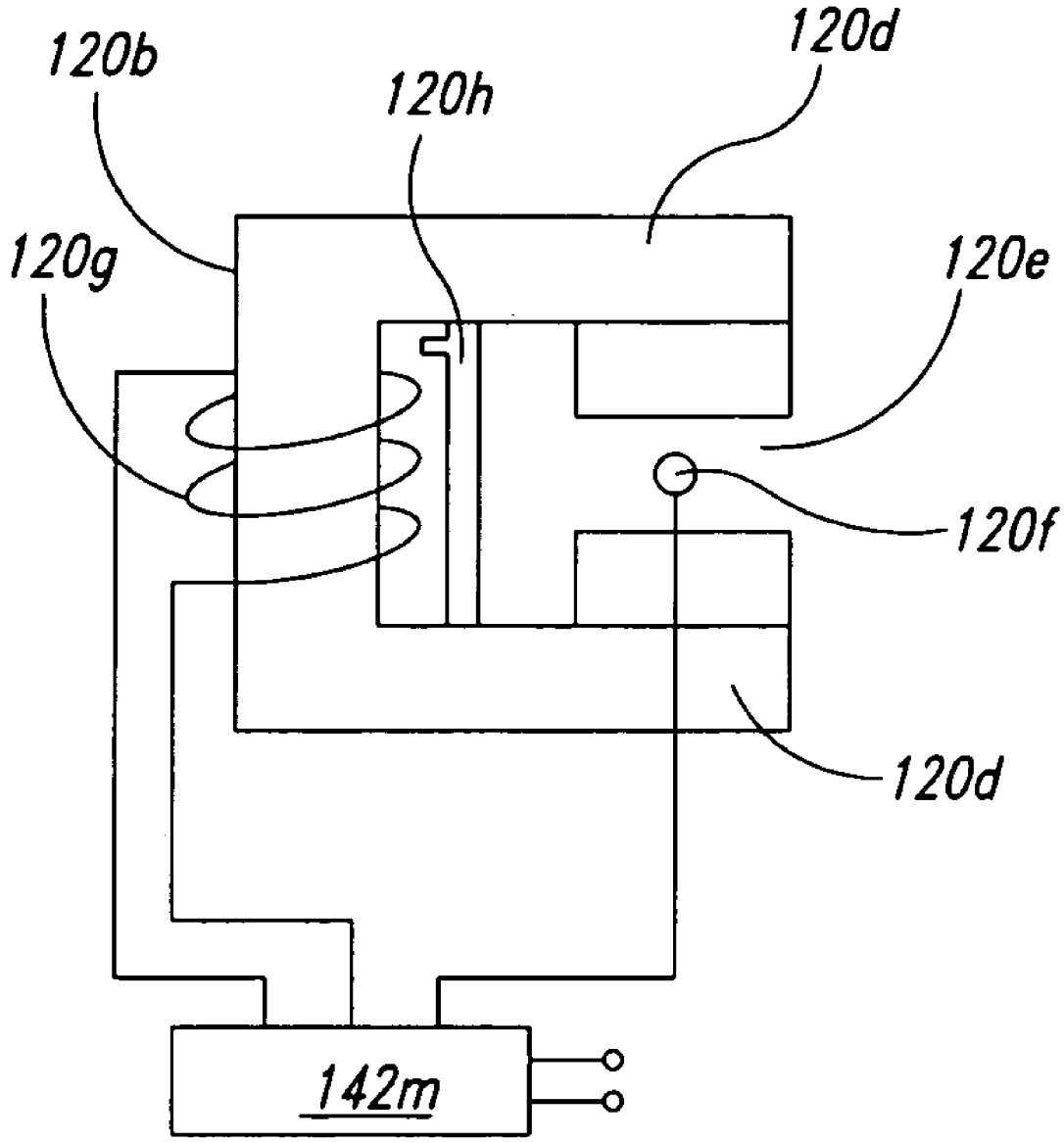
FIG. 5 is a schematic view of a magnetic section including a magnetic shunt according to one illustrated embodiment.

FIG. 5 shows a magnetic section 120 similar to that of FIG. 4 and further having a magnetic shunt 120*h* disposed across the yoke ends 120*d* of the yoke 120*b*. The magnetic shunt 120*h* has an opposite temperature coefficient of remnant flux density than the permanent magnets 120*a* attached to the yoke-ends 120*d* of the yoke 120*b*. The use of the magnetic shunt 120*h* reduces deviations of the magnetic field within the magnetic gap 120*e* that are caused by temperature variations, so that less current is required to maintain the magnetic flux within the desired range.

Figure 3:
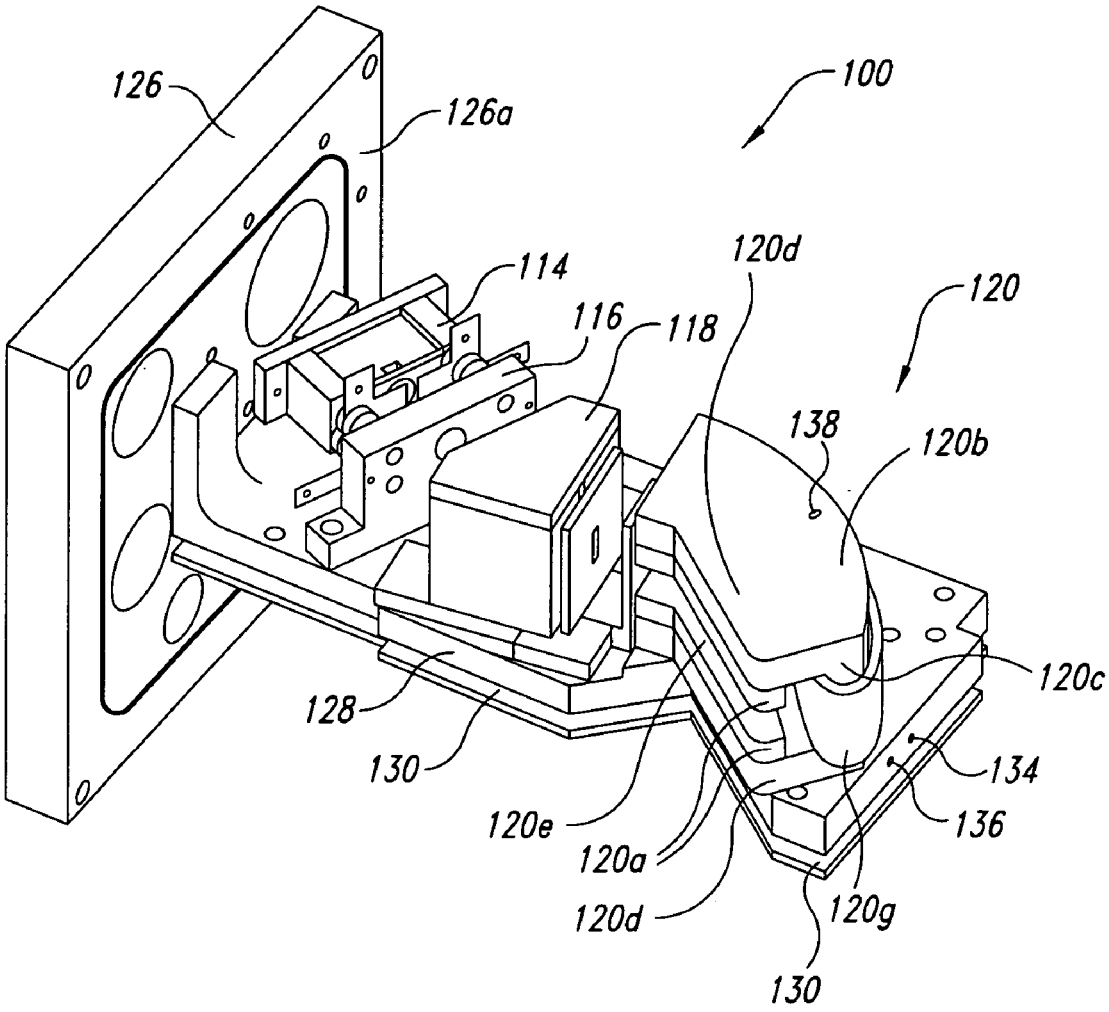
FIG. 3 is a top, front, right isometric view of the mass spectrometer of FIG. 2 from which input/output leads have been omitted for better illustrating certain aspects of the embodiment.
Figure 6:
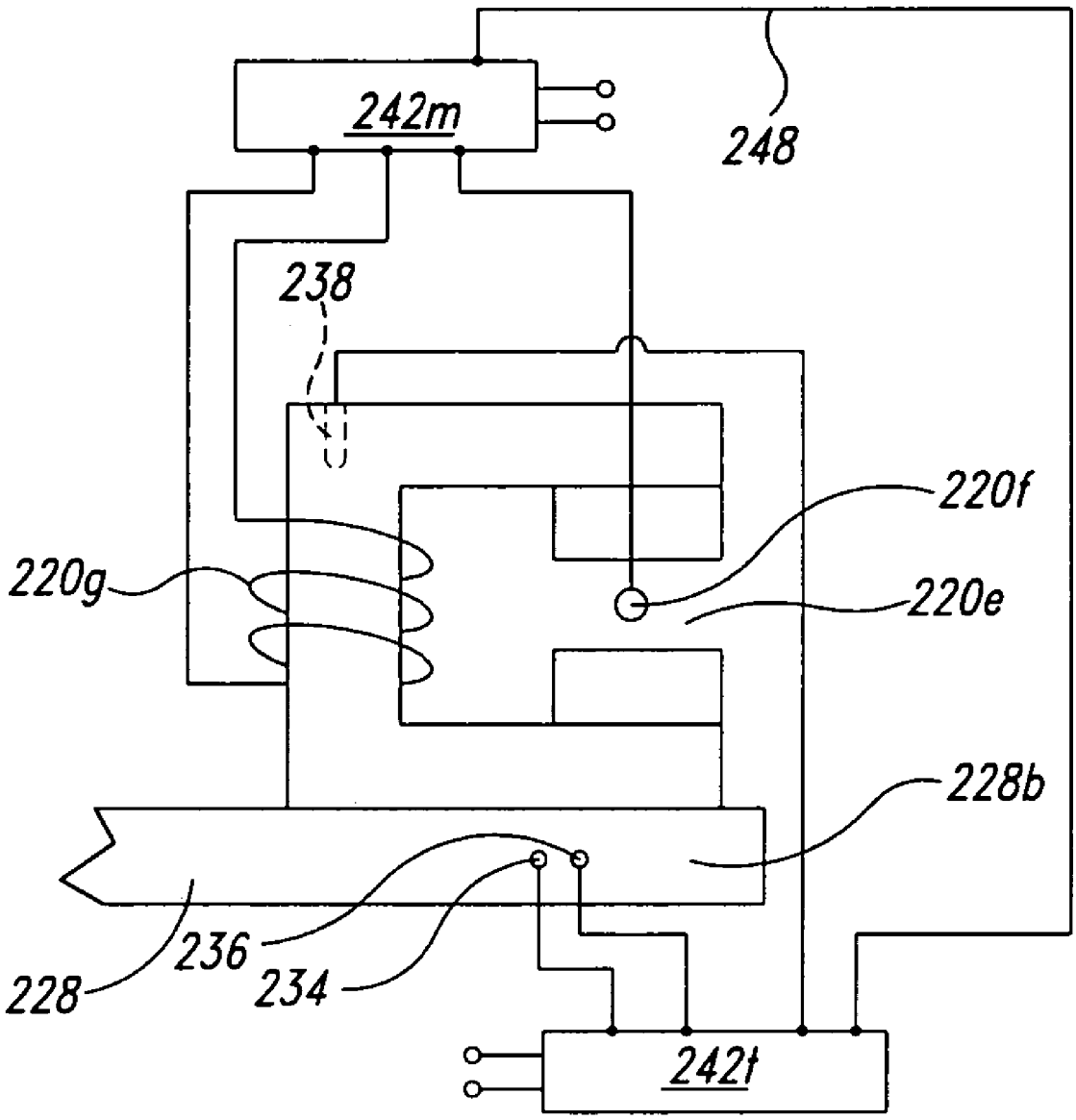
FIG. 6 is a schematic view of a magnetic section of a mass spectrometer having a temperature controller according to one illustrated embodiment.
Figure 7:
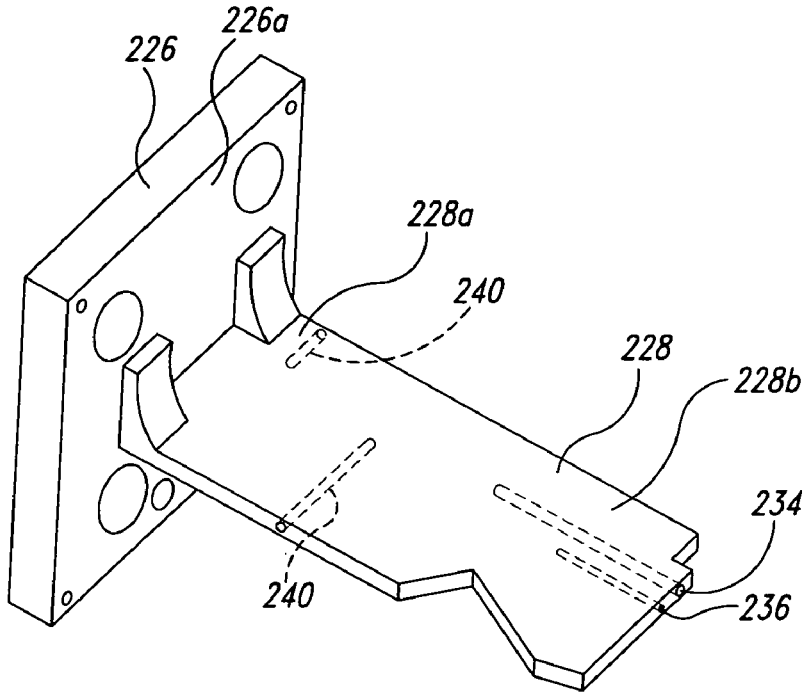
FIG. 7 is a top, front, right isometric view of a base plate supported by a vacuum flange with a heating element and temperature sensors disposed within the base plate according to one illustrated embodiment.
Figure 8:
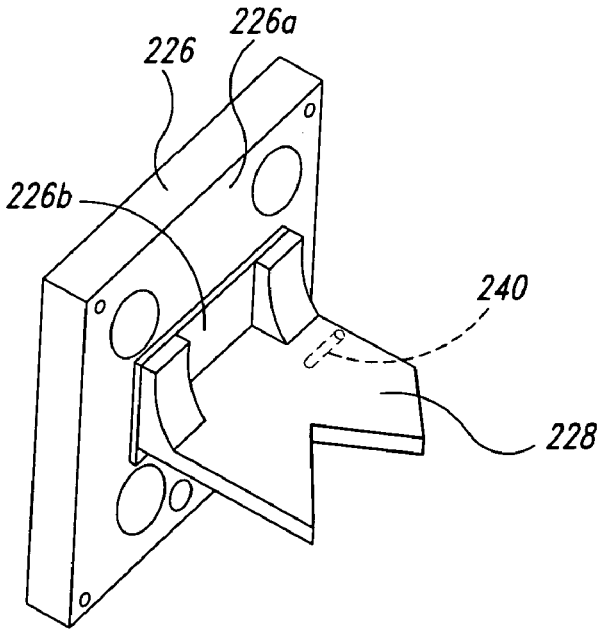
FIG. 8 is a top, front, right broken isometric view of a base plate supported by a vacuum flange with a thermal insulator arranged between the base plate and the vacuum flange.

FIGS. 6–8 show a magnetic section 200, which is supported on a base plate 228. A first heating element 234 and/or a first temperature sensor 236 may be disposed within the base plate 228 (FIG. 3) according to one illustrated embodiment.

As illustrated in FIG. 7, the first temperature sensor 236 is positioned in the vicinity of the first heating element 234. In addition, both the first temperature sensor 236 and the first heating element 234 are positioned in the vicinity of the back end 228*b* of the base plate 228. Additionally or alternatively, a second temperature sensor 238 may be positioned in another location of the magnetic section 220.

Referring to FIG. 6, the first heating element 234 and the temperature sensors 236, 238, may be electrically coupled to a temperature controller 242*t*, which regulates a temperature of the magnetic section 220 within a desired range. An amount of electrical energy provided to the first heating element 234 from the temperature controller 242*t* is determined based on the temperature of the magnetic section 220 as measured by the first and second temperature sensors 236, 238, respectively.

It is understood and appreciated that additional heating elements (not shown), and additional temperature sensors 240, may be arranged in, on or proximate the base plate 228 in a similar manner as the first heating element 234 and the first temperature sensor 236.

Referring back to FIG. 6, the electromagnet controller 242*m* receives magnetic flux information from the magnetic sensor 220*f* and regulates a current passing through the coil 220*g* so that the magnetic flux detected by the magnetic sensor 220*f* is maintained in the desired range.

In addition, the temperature controller 242*t* provides electrical energy to the first heating element 234. The temperature in the vicinity of the heating element 234 is measured by the temperature sensor 236 and the information is transferred to the temperature controller 242*t*. When the temperature indicated by the temperature sensor 236 reaches a desired level, the electromagnet controller 242*m* interrupts the transfer of electrical energy. This process repeats when the temperature sensor 236 detects a change in temperature of about 1–3° C.

Placing the first temperature sensor 236 in the vicinity of the first heating element 234, and controlling the energy provided to the first heating element 234 based on feedback provided by at least the first temperature sensor 236, can achieve good control of the temperature of the base plate 228. If the temperature were detected by a temperature sensor positioned away from the first heating element 234, then the temperature of the base plate 228 and the magnetic section 220 could be more difficult to maintain due to heat transfer hysterisis.

In an alternative embodiment, only the temperature controller 242*t* is used to control the magnetic flux in the magnetic gap 220*e*. In another embodiment, the electromagnet controller 242*m* operates in conjunction with temperature controller 242*t* to control the magnetic flux. Because controlling the temperature of the base plate 228 takes time, the current in the coil 220*g* can be adjusted during this lag time, if needed. During the period of temperature transition, any tendency for the magnetic flux to change can be controlled by the electromagnet controller 242*m*. The magnetic sensor 120*f* induces the electromagnet controller 242*m* to provide current to the coil 220*g* in an appropriate amount and direction so that the magnetic flux remains within the desired range.

The electromagnet controller 242*m* and temperature controller 242*t* communicate with each other through line 248.

Using the electromagnetic field produced by the coil 220*g* to fine tune the magnetic flux may require less energy when the temperature of the base plate 228 is contemporaneously controlled and/or when the magnetic shunt 120*h* (FIG. 5) is disposed across the yoke (FIG. 4) of the magnetic section 120, 220, respectively.

This embodiment requires less energy to adjust the current in the coil 220*g* to control the magnetic flux.

It is understood that the temperature at which the magnetic section 220 and the back portion 228*b* of the base plate 228 should be maintained depends on the intended use of the MS and an environment in which the MS will be used. This temperature may, and likely will exceed, the sum of the environmental temperature and/or the temperature of the ionizer 14, which may include a hot glowing filament made from Rhenium. For example, when the sum of the temperatures is in the range of about 10–30° C., an operational temperature of the base plate 228, and the magnetic section 220, should be in the range of about 40–50° C.

In another embodiment illustrated in FIG. 8, a thermal insulator 226*b* is disposed between the vacuum flange 226 and the base plate 228 to reduce an amount of heat escaping by conductivity through the vacuum flange 226.

One possible advantage of the embodiments of the MS disclosed herein is that the MS operates quickly, so that many samples can be analyzed even with small microbore columns and/or small capacity vacuum pumps.

All of the above U.S. patents, U.S. patent application publications, U.S. patent applications, foreign patents, foreign patent applications and non-patent publications referred to in this specification and/or listed in the Application Data Sheet, including U.S. Pat. No. 5,801,380; U.S. Pat. No. 6,576,899; U.S. Pat. No. 6,403,956; U.S. Pat. No. 5,317,151; U.S. Pat. No. 6,182,831; U.S. Pat. No. 6,191,419; U.S. Pat. No. 6,046,451; and U.S. patent application Ser. No. 09/744,360, are incorporated herein by reference, in their entirety.

In addition, all of the above publications, including "A. A. Scheidemann, R. B. Darling, F. J. Schumacher, and A. Isakarov, Tech. Digest of the 14th Int. Forum on Process Analytical Chem. (IFPAC-2000), Lake Las Vegas, Nev., Jan. 23–26, 2000, abstract 1–067"; "R. B. Darling, A. A. Scheidemann, K. N. Bhat, and T. C. Chen, Proc. of the 14th IEEE Int. Conf. on Micro Electro Mechanical Systems (MEMS 2001), Interlaken, Switzerland, Jan. 21–25, 2001, pp. 90–93" and "Nier, D. J. Schlutter Rev. Sci. Instrum. 56(2), page 214–219, 1985"; and "T. W. Burgoyne et. al. J. Am. Soc. Mass Spectrum 8, pages 307–318, 1997" are incorporated herein by reference in their entirety.

The above description of illustrated embodiments, including what is described in the Abstract, is not intended to be exhaustive or to limit the invention to the precise forms disclosed. Although specific embodiments of and examples are described herein for illustrative purposes, various equivalent modifications can be made without departing from the spirit and scope of the invention, as will be recognized by those skilled in the relevant art. The teachings provided herein can be applied to a variety of mass spectrometers, to include the exemplary embodiments described above.

The invention claimed is:

1. A mass spectrometer, comprising:

a base plate;

a vacuum housing comprising at least one wall and a vacuum flange configured to form a vacuum chamber, the vacuum flange sealingly coupled to the base;

a first heating element located within a first portion of the base plate;

a first temperature sensor located within a second portion of the base plate, the first portion separated from the second portion by an amount of base plate material; and a magnetic section supported on the base plate, the magnetic section including:

a yoke having a main body, a first yoke end, and a second yoke end;

a first permanent magnet coupled to the yoke proximate to the first yoke end;

a second permanent magnet coupled to the second yoke end, wherein the second permanent magnet is spaced apart from the first permanent magnet to form a magnetic gap therebetween;

a coil formed around at least a portion of the yoke, the coil configured to carry a current, wherein a magnetic flux is produced when the current passes through the coil;

a magnetic sensor disposed in the vicinity of the magnetic gap to produce signals indicative of a measurement of the magnetic flux; and a controller in communication with the magnetic sensor and the coil, the controller configured to receive the signals indicative of the measurement of the magnetic flux from the magnetic sensor and to regulate the current passing through the coil to controllably maintain the magnetic flux within a desired range.

2. The mass spectrometer of claim 1, further comprising:

a magnetic shunt disposed between the first yoke end and the second yoke end, wherein the magnetic shunt reduces changes in the magnetic gap when a first temperature of the yoke is varied to a second temperature.

3. The mass spectrometer of claim 1 wherein the location of the first portion and the second portion correspond to a region of the base plate where the magnetic section is supported.

4. The mass spectrometer of claim 1, further comprising:

a temperature controller coupled to control the first heating element and communicatively coupled to the first temperature sensor, wherein the temperature controller is configured to regulate the first heating element according to a temperature measurement of the base plate acquired by the temperature sensor.

5. A mass spectrometer, comprising:

a base plate;

a vacuum housing comprising at least one wall and a vacuum flange configured to form a vacuum chamber, the vacuum flange sealingly coupled to the base;

a magnetic section configured to generate a magnetic flux and supported on the base plate;

a first heating element located within a first portion of the base plate;

a first temperature sensor located within a second portion of the base plate; and a temperature controller in electrical communication with the first heating element and the first temperature sensor, wherein the temperature controller is configured to regulate the first heating element to control a temperature of the base plate and to controllably maintain the magnetic flux within a desired range.

6. The mass spectrometer of claim 5, further comprising:

a second heating element located within a second portion of the base plate; and a second temperature sensor located within a third portion of the base plate.

7. The mass spectrometer of claim 5 wherein the magnetic section further comprises:

a yoke having a main body, a first yoke end, and a second yoke end;

a first permanent magnet coupled proximate the first yoke end;

a second permanent magnet coupled proximate the second yoke end, wherein the second permanent magnet is spaced apart from the first permanent magnet to form a magnetic gap; and a coil formed around at least a portion of the main body of the yoke, the coil configured to carry a current and to produce the magnetic flux when the current passes through the coil.

8. The mass spectrometer of claim 7, further comprising:

a magnetic shunt disposed across the first yoke end and the second yoke end, wherein the magnetic shunt reduces changes in the magnetic gap when a first temperature of the yoke is varied to a second temperature.

9. The mass spectrometer of claim 7, further comprising:

a magnetic sensor disposed in the vicinity of the magnetic gap to provide a signal indicative of a measure of the magnetic flux; and a controller in communication with the magnetic sensor and the coil, the controller configured to receive the signal indicative of the measure of the magnetic flux from the magnetic sensor and to regulate the current passing through the coil based at least in part on the measure of the magnetic flux.

10. A method of controlling a mass spectrometer, the method comprising;

measuring a base plate temperature with a temperature sensor disposed within a first region of the base plate;

determining an amount of temperature adjustment for a heating element disposed within the first region of the base plate in response to the measured base plate temperature; and controllably adjusting a temperature of the heating element to controllably maintain an amount of relative separation between a first pair of permanent magnets located within the magnetic section and to controllably maintain a magnetic flux present between the first pair of permanent magnets within a desired range.

11. The method of claim 10, further comprising:

measuring the magnetic flux present within a region of the magnetic section; and controlling an amount of current passing through a coil within the magnetic section based on the measured magnetic flux, wherein the current is controlled to maintain the magnetic flux within a desired range.

12. The method of claim 11 wherein measuring the magnetic flux present within the region of the magnetic section includes measuring the magnetic flux within a magnetic gap formed by two opposing permanent magnets.

13. The method of claim 11 wherein measuring the magnetic flux present within the region of the magnetic section includes measuring the magnetic flux with a magnetic sensor located substantially within a magnetic gap formed by two opposing permanent magnets.

14. The method of claim 11 wherein controlling the amount of current passing through the coil based on the measured magnetic flux includes incrementally adjusting the amount of current to compensate for a deviation in the magnetic flux resulting from a change in a temperature of the magnetic section.

15. The method of claim 11, further comprising:

shunting across a first yoke end and a second yoke end of the yoke to limit an amount of relative separation between the two opposing permanent magnets.

16. The method of claim 10, further comprising:

shunting across a first yoke end and a second yoke end of a yoke located in the magnetic section to limit the amount of relative separation between the first pair of permanent magnets.

* * * * *